United States Patent [19]

Hunley et al.

[11] 4,093,010

[45] June 6, 1978

[54] CAMERA CASE

[75] Inventors: Benjamin L. Hunley; James C. Packard, both of Clinton, Tenn.

[73] Assignee: Hunley and Packard, Clinton, Tenn.

[21] Appl. No.: 793,719

[22] Filed: May 4, 1977

[51] Int. Cl.[2] ..... A45C 11/38

[52] U.S. Cl. ..... 150/52 J; 190/51; 217/7; 206/316; 206/523

[58] Field of Search ..... 150/52 R, 52 J; 190/51; 217/7; 220/22, 22.1; 206/316, 521, 523, 591, 592, 593, 594

[56] References Cited

U.S. PATENT DOCUMENTS

| | | | |
|---|---|---|---|
| 1,144,835 | 6/1915 | Gibson | 217/7 |
| 1,921,110 | 8/1933 | Wheary | 190/51 |
| 2,223,219 | 11/1940 | Mayerovitz | 150/52 J |
| 2,245,999 | 6/1941 | Plotkin | 190/51 |
| 2,998,129 | 8/1961 | Bekins | 206/523 |
| 3,330,388 | 7/1967 | Stein | 190/51 X |
| 3,362,448 | 1/1968 | Everburg | 150/52 J |
| 3,381,782 | 5/1968 | Ikelheimer | 190/51 |
| 3,421,679 | 1/1969 | Goldman | 206/523 X |
| 3,554,429 | 1/1971 | Cohen | 220/22 X |

*Primary Examiner*—Donald F. Norton

*Attorney, Agent, or Firm*—Fitch, Even, Tabin & Luedeka

[57] ABSTRACT

A case for fragile articles comprises a rigid container including a generally rectangular bottom, a peripheral upstanding wall, including side walls and end walls, and a lid, defining a main compartment. The interior of the main compartment is covered with resilient cushioning means. First elongated partition means divide the main compartment into first compartments. The first partition means includes a first support member which is rigid and generally planar and extends between opposed side walls. The length of the first support member is such that it extends into and compresses a portion of the cushion means covering the side walls. Cushion means cover the top edge and planar surfaces of the first partition. Second elongated partition means divides the first compartment into second compartments. The second partition includes a second support member which is rigid and generally planar and extends between an end wall and the first partition. The length of the second support member is such that it extends into and compresses the cushion means covering the end wall and the first support member. Cushion means cover the top edge and planar surfaces of the second support member.

5 Claims, 4 Drawing Figures

CAMERA CASE

The present invention relates generally to the field of carrying cases for fragile articles. More particularly, the invention relates to protective carrying cases, for cameras and other photographic equipment, having adjustably-sized compartments.

Cameras and other photographic equipment, such as lenses, are fragile items, and it is frequently necessary to transport them to remote locations. It is therefore necessary to provide a carrying case which retains the equipment in fixed positions when the case is being moved.

For the photographer who has a particular set of equipment which never varies, it is possible to develop a case having individual compartments custom-designed for each piece. Frequently this is accomplished through use of a single block of resilient foam which essentially fills the interior of the case. Portions of the foam are carved away to provide individual compartments having the shape of the articles to be received. While this "custom" system holds the articles safely, it makes no allowance for the fact that photographers change their equipment quite frequently — even from day to day, depending upon the type of picture to be taken. A compartment carved for one object often does not accept a different object. Therefore, a custom-designed case is not satisfactory for most photographers.

There have also been attempts to provide adjustably sized compartments in camera equipment cases such as providing one with adjustable spacer blocks which are bolted through the bottom of the case, as shown in U.S. Pat. No. 2,707,506. However, these cases are difficult to adjust and the adjustment must be precise if the equipment is to be firmly held in position.

It is therefore an object of the present invention to provide a case which securely holds articles in a cushioned manner. It is also an object to provide a case which includes compartments the size of which is alterable quickly and easily. Other objects and advantages of the invention will become apparent from the following detailed description, particularly when taken with reference to the drawings in which.

Figure 1:
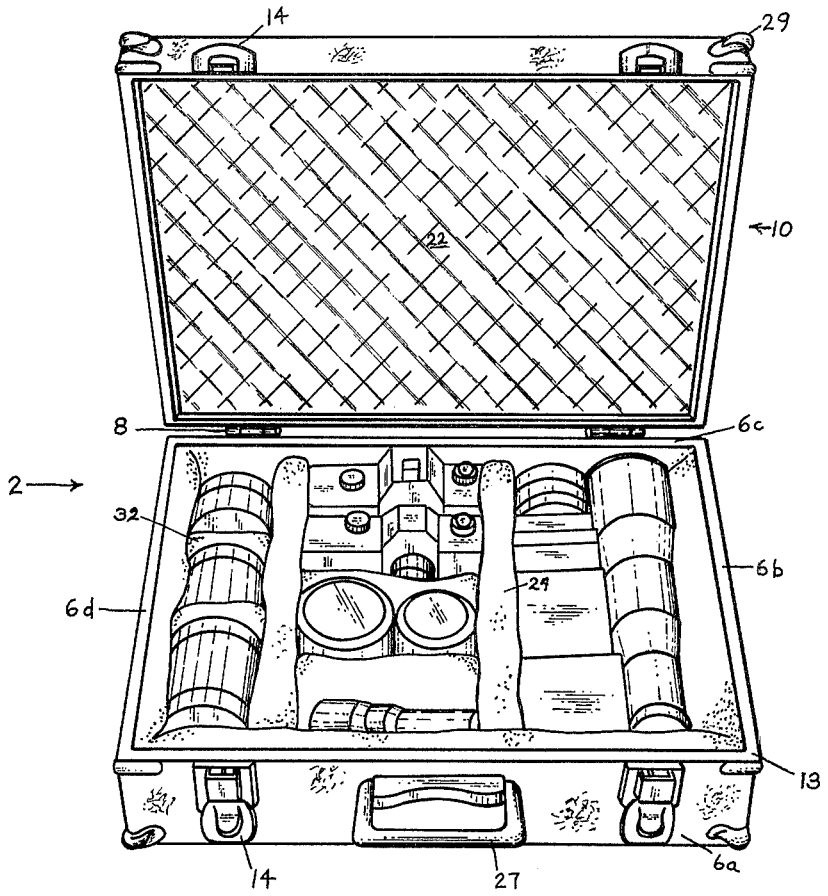
FIG. 1 is a perspective view of a camera case embodying various features of the present invention.
Figure 2:
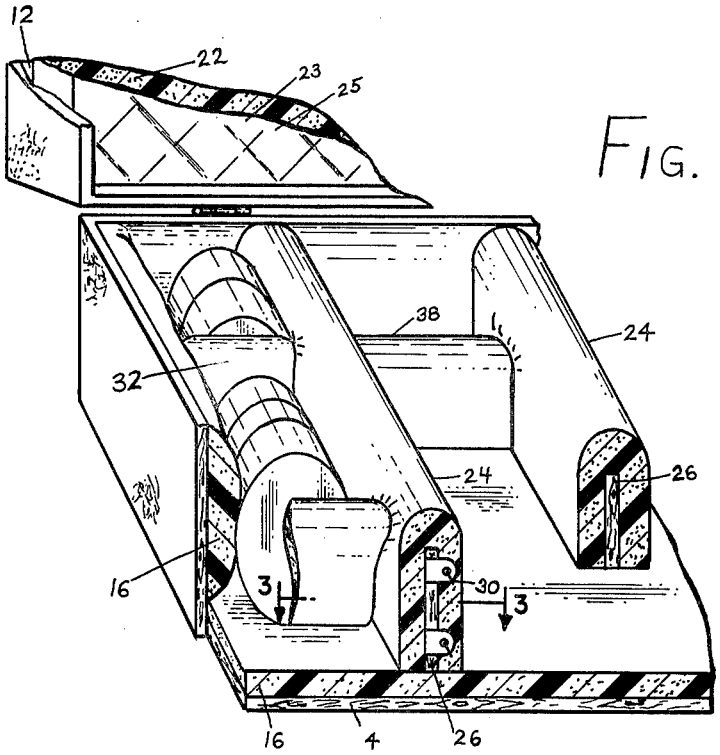
FIG. 2 is a perspective view, partly in section, of the camera case shown in FIG. 1.
Figure 3:
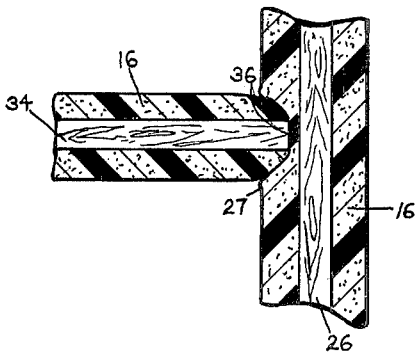
FIG. 3 is a sectional view taken along line 3—3 in FIG. 2.
Figure 4:
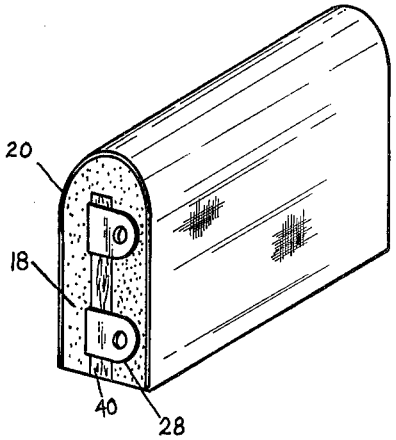
FIG. 4 is a perspective view of one end of an adjustable partition which is employed in the case shown in the preceding Figures.

As illustrated in the drawings, a rigid container 2, comprising a generally rectangular bottom member 4 and an upstanding peripheral wall 6 including parallel opposed side wall portions 6*a* and 6*c*, and parallel end wall portions 6*b* and 6*d*. The bottom member 4 and wall 6 define an open-topped main compartment. Hinge means 8 attach the side wall 6*c* to a mating rigid lid 10 which includes an interior surface 12 and is adapted to matingly unite with the upper edge 13 of the upstanding wall 6. Latch means 14 are attached to the lid 10 and side wall 6*a* to releasably secure the side wall 6 and lid 10 in a closed position.

Resilient cushioning means 16 cover and are attached to the bottom 4, side wall 6 and interior surface 12 of the lid 10. The cushioning means 16 for the bottom 4 and side wall 6 preferably comprise a layer of resilient open-cell foam 18 such as polyethelene foam having a depth of about one centimeter. The foam layer 18 is preferably covered with a low-friction protective layer 20, such as felt.

The interior surface 12 of the rigid lid 10 is preferably covered with a layer of resilient open cell foam 22, such as polyethylene foam, having an "egg-carton" texture. This is to say the texture comprises a checked pattern of alternating depressions 23 and mounds 25. The "egg-carton" texture provides accommodation for varying heights of equipment. The mounds 25 apply pressure to objects barely extending above the side wall 6. However, taller objects do not receive excessive pressure because the depressions 23 receive a portion of the object and the mounds 25 adjust by moving laterally into depressions 23, as well as by being compressed.

Conventional handle means 27 are attached to the base 2 on the exterior surface of the side wall 6. Conventional reinforcing means 29 are applied to the corners of the case 2.

A first elongated partition 24 is secured within the main compartment, dividing the main compartment into smaller first compartments. The first partition 24 includes a generally planar, elongated, rigid support member 26 disposed generally parallel to the end walls 6*b* and 6*d*. The support member 26 extends between the opposite side walls 6*a* and 6*c*, generally perpendicular to the bottom member 4. The length of the support member 26 is slightly less than the length of the end walls 6*b* and 6*d* and greater than the distance between the resilient cushions 16 covering the side walls 6*a* and 6*c*. Thus, the first support member 26 extends into and compresses the resilient cushion portion disposed between the side wall portions 6*b* and 6*d* and the support member ends. The uncompressed cushion portions immediately adjacent to the support member 26 form shoulders 27 to prevent lateral motion by the partition 24. In addition, more permanent attachment means, tab means 28, are attached to the ends of the first partition 24. Tacks 30 are inserted through the tab means 28 and resilient cushions 16 and into the side walls 6*a* and 6*c* to ensure that the partition 24 is fixed even when normal lateral pressures are applied thereto in the event that it is desired to maintain the partition in a fixed position for some period of time.

The partition support member 26 is resiliently cushioned in a manner similar to that of the side wall 6 and the bottom 4: preferably a layer of resilient open cell foam 18 adhered as by cement or adhesive, to the exposed surfaces, i.e. top and planar sides, and covering and attached to the foam is a protective, low-friction material 20 such as a layer of felt. The support member preferably comprises a wooden slat, such as one-quarter inch plywood.

A plurality of second elongated partitions 32 are adjustably disposed within the first compartments to divide the first compartments into even smaller second compartments. Each second partition 32 includes a generally planar elongated rigid support member 34 disposed generally parallel to the side walls 6*a* and 6*c*. The second support member 34 extends between the end wall 6*b* or 6*d* and the first partition 24, generally perpendicular to the bottom member 4. The length of the second support member 34 is such that the second support member 34 extends into and compresses the cushion means attached to the end wall 6*b* or 6*d* and the cushion means attached to and covering the first partition support member 26. The uncompressed resilient cushion portion immediately adjacent to the compressed area resists lateral motion by the second partition 32. However, parallel relationship of the end wall 6*b* or 6*d* and the first partition 24 makes the second partition 32 selectively adjustable to any location therebetween. As desired, tab means 28 are attached to the ends 36 of the second support member 34. Tacks 30 are insertable through the tab means 28 in the event a relatively permanent attachment of the second partition 32 is desired.

The second partition members 34 are covered with resilient cushions in the same manner as the first partition: preferably a layer of resilient open-cell foam 18 adhered as by cement or adhesive to the exposed surfaces, i.e. the top and planar sides, and attached to the foam is a protective low-friction material such as felt.

As desired, a plurality of first partitions 24 are spaced apart and secured within the main compartment. A third compartment is thus defined between the side walls 6*a* and 6*c* and a pair of first partitions 24. Third partition members 38, similar to the second partition members 32, are adjustably disposed between the pair of first partitions 24, parallel to the end walls 6*a* and 6*c*. The lengths of the third support member 40 included in the third partition is such that the third support member 40 extends into and compresses the resilient cushion means 16 attached to the pair of spaced apart first partitions 24.

In use, the adjustable partitions 32 are removed from the case 2, leaving the bottom 4, side wall 6 and first partitions 24 to define first compartments. A unit of photographic equipment, such as a camera or even severial pieces of equipment, is inserted adjacent the cushion of the side wall 6*c*, between the end wall 6*d* and the first portion 24. A second partition 32 is then forced into a position adjacent the equipment by compressing portions of the cushions on the side wall 6*d* and first support member 26. The second partition 32 is preferably pressed against the equipment, compressing the cushions on the end wall portion 6*c* and on the second support member 34. Thus, the equipment is "grasped" by the cushions 16 in a manner similar to that in which the adjusting partitions are prevented from moving: the uncompressed cushion portion adjacent the compressed portion resists motion by the unit. Other equipment is similarly secured in adjustable compartments, after which securement, the lid 10 is hingedly closed and the latch means 14 are secured. In many situations, the articles will be additionally "grasped" by the cushions 16 and 22 covering the bottom 4 and cover interior surface 12, respectively.

Using the disclosed invention, a large range of sizes and shapes of photographic equipment (or other fragile articles) is securable in compartments adapted to the particular sizes and shapes. The compartments are easily and quickly changed to adapt to different sizes, shapes or arrangements of equipment.

While a preferred embodiment has been shown and described, it will be understood that there is no intent to limit the invention by such disclosure, but rather, it is intended to cover all modifications and alternate constructions falling within the spirit and scope of the invention as defined in the appended claims.

What is claimed is:

1. A case for fragile articles comprising a rigid container including a generally rectangular bottom member, upstanding walls including a pair of end walls including upper edges and a pair of side walls including upper edges attached to the periphery of said bottom member, said bottom member and said walls defining an open topped main compartment, a lid proportioned to unite with the upper edges of said walls to close the main compartment, resilient cushioning means having a smooth continuous surface on the interior of said compartment covering and attached to the lid, the bottom member, said end walls and said side walls, first elongated partition means for dividing said main compartment into smaller first compartments, said first partition means having a rigid, generally planar, elongated support member, said support member extending between opposed side walls of said container and extending generally perpendicular to the bottom member, cushioning means having a smooth continuous surface on the planar sides and top edge of said first partition support member, the length of said first partition rigid support member being such that it extends into and compresses the cushioning means on said opposed side walls without penetrating the surface of said cushioning means so that the deformation of the cushioning means at least in part holds the first support member in position, and second elongated partition means for dividing one of said first compartments into smaller second compartments, said second partition means having a rigid, generally planar, elongated support member, said support member extending between said first partition means and one of said upstanding walls other than said opposed walls, generally perpendicularly to the bottom member, cushioning means on the planar sides and top edge of said second partition support member, the length of said second partition support member being such that it extends into and compresses the cushioning means on one of said walls other than said opposed side walls and the cushioning means on said first partition support member without penetrating the surface of said cushioning means, so that the deformation of the cushioning means at least in part holds the second support member in position.

2. A case as described in claim 1 wherein a plurality of parallel spaced-apart first partitions divide said main compartment into first and third compartments, and third elongated partition means for dividing said third compartment, said third support member extending between said spaced-apart first partitions, generally perpendicular to the bottom member, cushioning means on the planar sides and top of said third partition support member, the length of said third support member being such that the third support member extends into and compresses the cushioning means on said first support members so that the deformation of the cushioning means at least in part holds the third support member in position.

3. The case as described in claim 1 wherein said first partition and said second partition define a sub-compartment which is smaller than the dimensions of the unit to be contained therein so that the insertion of the unit in the sub-compartment causes a deformation of the resilient cushioning means thereby holding the unit in position.

4. The case described in claim 1 wherein said resilient cushioning means comprises an open cell plastic foam covered with a low friction layer.

5. The case described in claim 1 wherein said first partition includes tab means attached to the ends thereof for attachment with tacks to the side walls.

* * * * *